United States Patent [19]

Lutrat

[11] 4,202,315

[45] May 13, 1980

[54] SINGLE CYCLE ROTARY ENGINE WITH CONSTANT FUEL FEEDING

[76] Inventor: Jacques Lutrat, 58, rue de Lorraine, Beaune, France, 21200

[21] Appl. No.: 888,121

[22] Filed: Mar. 20, 1978

Related U.S. Application Data

[63] Continuation-in-part of Ser. No. 655,361, Mar. 10, 1976, abandoned.

[51] Int. Cl.[2] ..... F02B 53/00

[52] U.S. Cl. ..... 123/249; 418/188; 418/191

[58] Field of Search ..... 123/229, 232, 238, 248, 123/249; 418/94, 183, 188

[56] References Cited

U.S. PATENT DOCUMENTS

| | | | |
|---|---|---|---|
| 1,378,897 | 5/1921 | Peterson | 123/249 |
| 1,936,211 | 11/1933 | Richter et al. | 123/249 |
| 2,297,529 | 9/1942 | Berry | 418/94 X |
| 2,944,533 | 7/1960 | Park | 123/249 |
| 3,712,273 | 1/1973 | Thomas | 123/248 |

FOREIGN PATENT DOCUMENTS

| | | | |
|---|---|---|---|
| 734001 | 4/1943 | Fed. Rep. of Germany | 123/249 |
| 2429553 | 1/1976 | Fed. Rep. of Germany | 123/248 |
| 427084 | 5/1911 | France | 123/248 |
| 444387 | 8/1912 | France | 123/249 |

*Primary Examiner*—Michael Koczo

*Attorney, Agent, or Firm*—David H. Semmes

[57] ABSTRACT

A single cycle, rotary combustion engine having constant fuel feeding. A circular housing defines an annular chamber through which a complementally curved pistonhead travels and works only upon the explosive or combustion stroke. A drive shaft is supported transversely of the housing, such that a piston rod extends radially from the drive shaft through an inner sealing drum so as to present the curved pistonhead within the annular chamber. Fuel and air are fed through the piston rod within the annular chamber via one or more ports in the trailing edge of the pistonhead. An ignition point and an expulsion port, mounted approximately 280° from each other are sealed from one another by rotary means. The engine is characterized by its elimination of valves and reciprocating parts.

10 Claims, 8 Drawing Figures

SINGLE CYCLE ROTARY ENGINE WITH CONSTANT FUEL FEEDING

CROSS-REFERENCES TO RELATED APPLICATIONS

A continuation-in-part of applicant's earlier application Ser. No. 655,361, filed Mar. 10, 1976 (now abandoned).

BACKGROUND OF THE INVENTION (1) Field of the Invention

Rotary engines, particularly single cycle rotary engines with constant fuel feeding, such that fuel admission, compression, explosion and expulsion are continuous.

SUMMARY OF THE INVENTION

According to the present invention a housing defines an outer annular chamber, while supporting a transverse drive shaft at the core of the housing. A radially extending piston rod is attached to the drive shaft and includes a curved piston-head supported within the annular chamber for rotation through a circular cycle. The rod and head include interior channels for continuous feeding of fuel and air at the trailing edge of the head. A spark plug ignition point extends into the chamber at one point and at another point, substantially separated from said ignition point, an expulsion port is provided. Rotary means are provided for sealing the annular chamber intermediate the explusion port and ignition point, except as the curved pistonhead rotates through this sector.

DESCRIPTION OF THE PREFERRED EMBODIMENTS

All moving parts are operated by a rotary movement to the exclusion of every other type of movement, so that the motor functions with total regularity. The feeding of the combustible gaseous mixture under pressure is effected in a continuous fashion, without jolts or shocks. It does not work in the admission, compression or explosive cycles, but rather works only in the explosive sequence continuously, as the drive shaft rotates. Finally, feeding does not require any valves although the gaseous mixture is burned within a closed space.

The engine may be employed in land, air and sea vehicles, as well as production units, for example, pumping or displacement of materials or with energy production such as electric alternators.

Unlike piston engines now in use, in which the piston or pistons reciprocates within a straight cylinder, this entirely rotary engine is characterized by one or more curved pistons, the cross section of which may be circular, ovoid, or otherwise which is suitable for rotation within a tunnel or annulus having a corresponding fitted cross section. If we take as our example a single-piston engine of this type, then the piston moves with a total rotary movement and is connected by a radially extending rod to a central shaft, intended to transmit the driving force.

Figure 1:
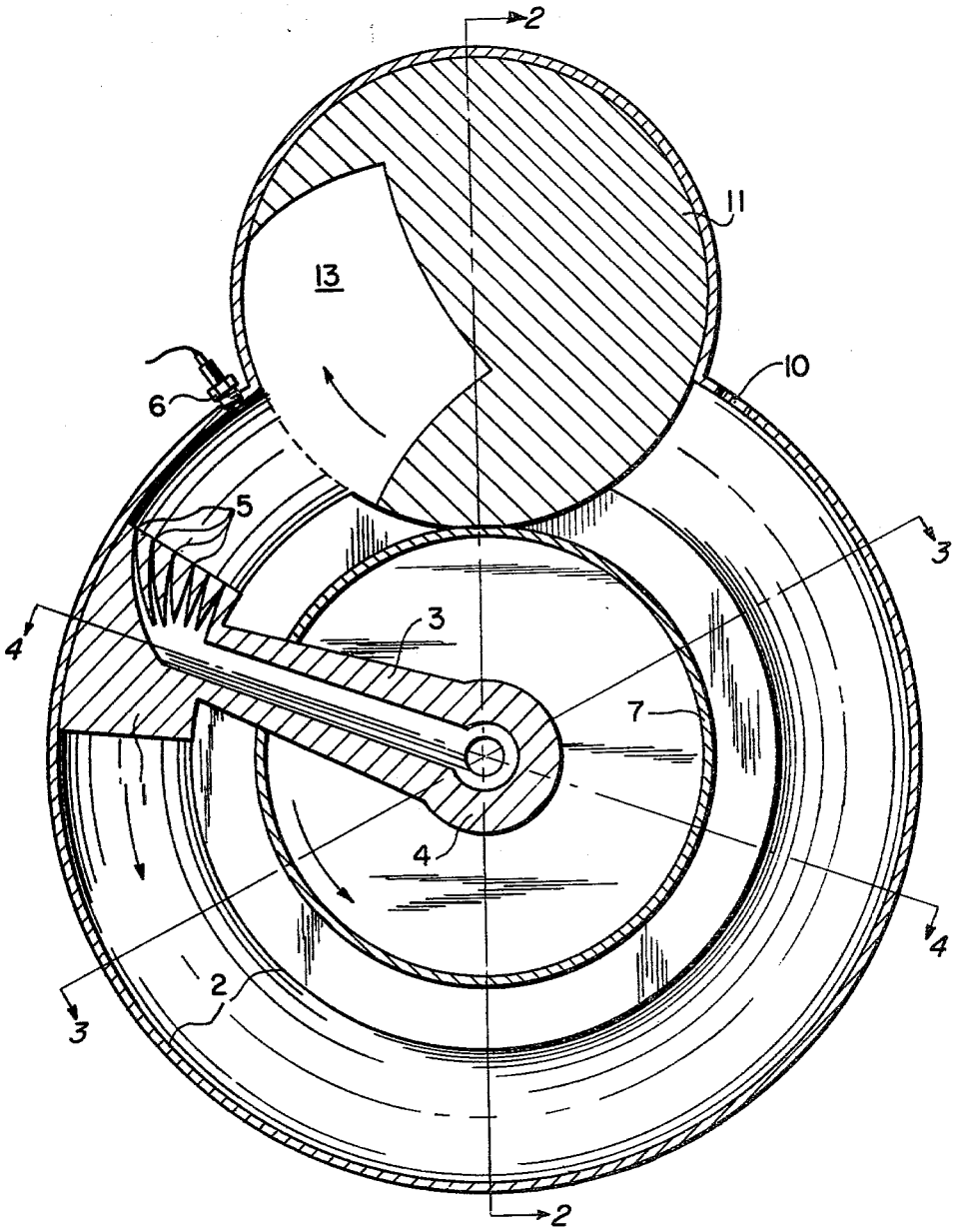
FIG. 1 is a transverse sectional view of the housing, showing the radially extending piston rod and pistonhead moving in a circular cycle away from the spark plug ignition point and towards the expulsion port 10.
Figure 2:
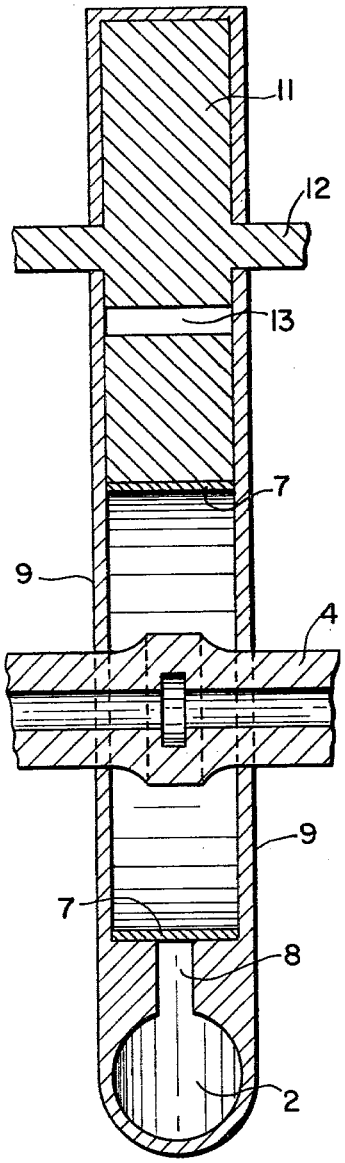
FIG. 2 is a transverse section view taken along the section line 2—2 of FIG. 1, showing the sealing engagement of the cylindrical drum with the rotary sealing means intermediate the ignition point and the expulsion point.
Figure 3:
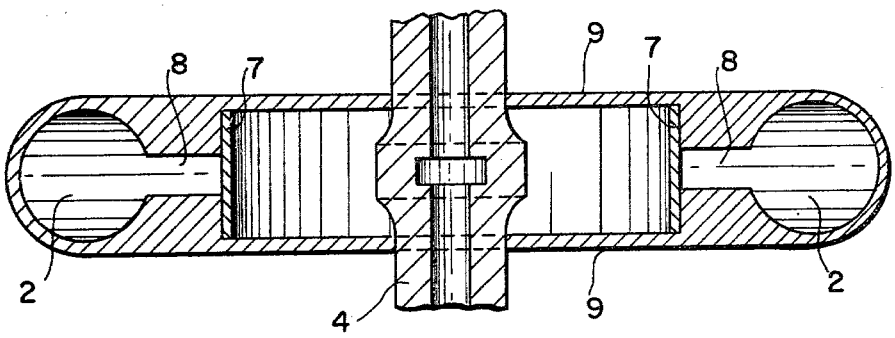
FIG. 3 is a transverse sectional view, taken along section line 3—3 of FIG. 1, showing the annular chamber and its open neck guide for the piston rod shaft.
Figure 4:
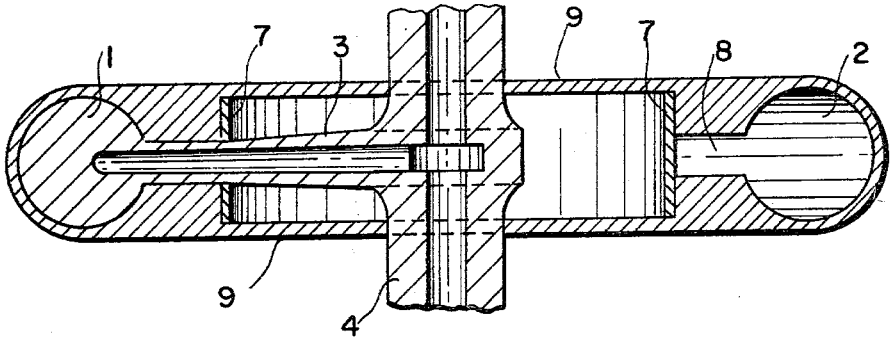
FIG. 4 is a transverse sectional view, taken along section line 4—4 of FIG. 1, showing the curved pistonhead in position within the annular chamber with its radially extending rod, having an inner fuel and air passage, extending through the open neck guide and onto the drive shaft to which it is connected.

As illustrated in FIG. 1, the constant admission of the feeding is effected through the hollow or grooved central shaft 4 and axially through the body of the hollow rod 3 as far as the piston 1 and then through openings 5 made on the posterior side of the piston. The feeding is conducted to the engine under pressure with the aid of a compressor or some other means. Manifestly, the air and fuel are independently delivered or injected at a pressure exceeding the pressure of combustion, so as to prevent flash back.

At least for starting, the ignition of the gaseous mixture must be induced for example, with the aid of a spark plug 6.

In its rotating movement the piston carries along a cylindrical ring, or drum 7 which overlays the neck, making possible the passage of the rod 3 through annular chamber or circular tunnel 2. The function of this cylindrical drum 7 is to ensure air and water tightness of the space in which the gaseous mixture is burned. Let us point out that even if the tightness is not total at this level, this will not result in any great inconvenience, for the tightness is completely secured, in any case, by the frame of rod 3 being closed on both sides by the housing walls 9. If prefered that cylindrical drum could be connected to the central shaft by spokes and a counter weight could be used on the drive shaft to equilibriate the weight of the pistonhead and rod.

Conventional combustion engines known up to the present time and utilizing gas mixtures are either four cycle or two cycle engines, or the type called "rotative" Wankel, in which the four operations are repeated: admission—compression—explosion (only productive phase)—expulsion.

The principle of the entirely rotary engine presented here is, on the contrary, that of a monocycle for only the power stroke comes into play. In fact, when the piston has made a complete turn, the burned gasses are found on the anterior side, and it drives them before itself as far as the expulsion opening 10, which constantly remains open and requires no valve.

To obtain a good return it is necessary that the circular tunnel 2 in which the piston 1 moves be closed, starting with the passage of the piston beyond expulsion opening 10. This closing is effected by means of a grooved or indented drum or roller 11 with a diameter equal to the exterior diameter of the cylindrical rim 7 and having contact with the latter. It is driven around a suitable axle or shaft 12 with a rotary movement in the opposite direction from that of the cylindrical rim 7 and at the same speed, by means of a gearing device, a notched belt, or some other suitable arrangement connecting the central shaft with the drum shaft. The drum or roller 11 includes a groove (or indentation) 13 sufficient to allow the passage of the piston upon each revolution.

It is understood, of course, that opposite this grooved drum 11 the thickness of the neck 8 permitting the passage of the rod is reduced in accordance with a curved form having the same radius as drum 11 itself, until it becomes zero at the place where the grooved drum enters into contact with the cylindrical rim.

The cooling may be obtained by water, air or any other fluid and may be lubricated conventionally.

Figure 5:
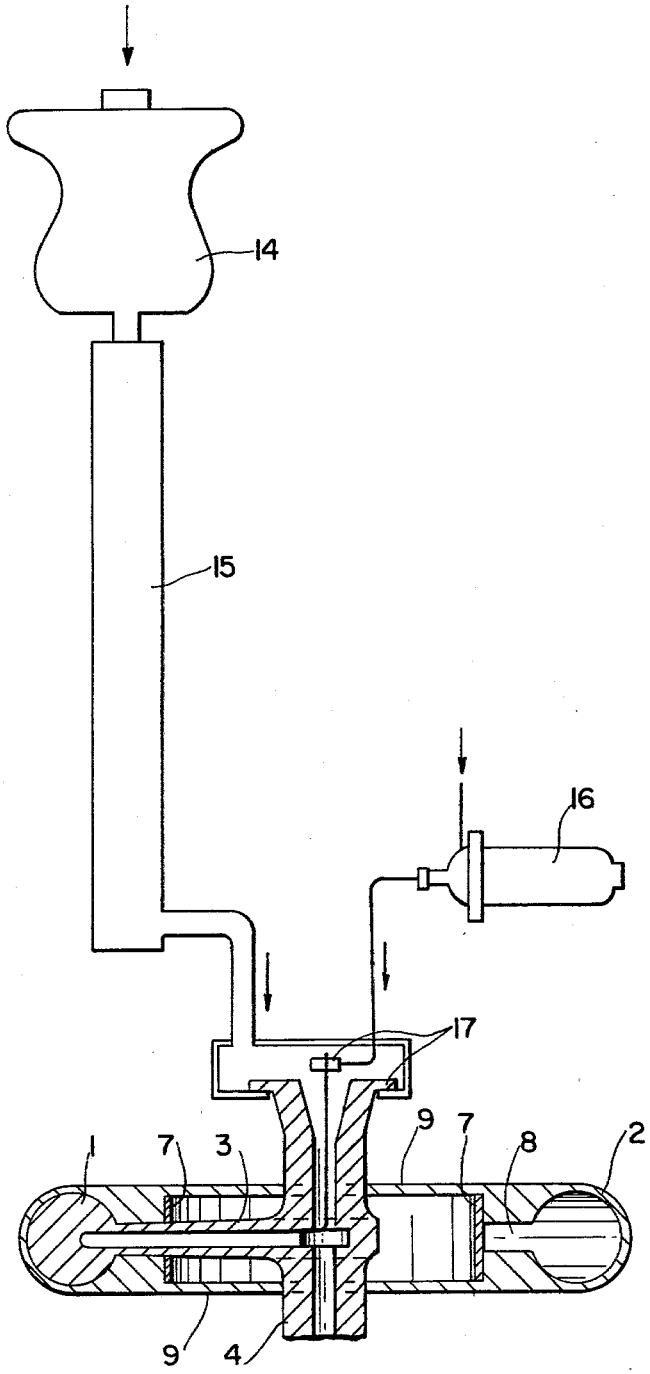
FIG. 5 is a schematic view, showing a conventional means of providing a flexible drive means and a source of pressurization in connection with the present invention.

In FIG. 5 there is illustrated a conventional means of providing a flexible drive and a source of pressurization. A conventional air compressor designated 14 may be employed, together with a radiator or cooling unit 15. An fuel pump 16 may be provided together with a rotary joint 17 which may be of a knee joint or bracelet type.

Figure 6:
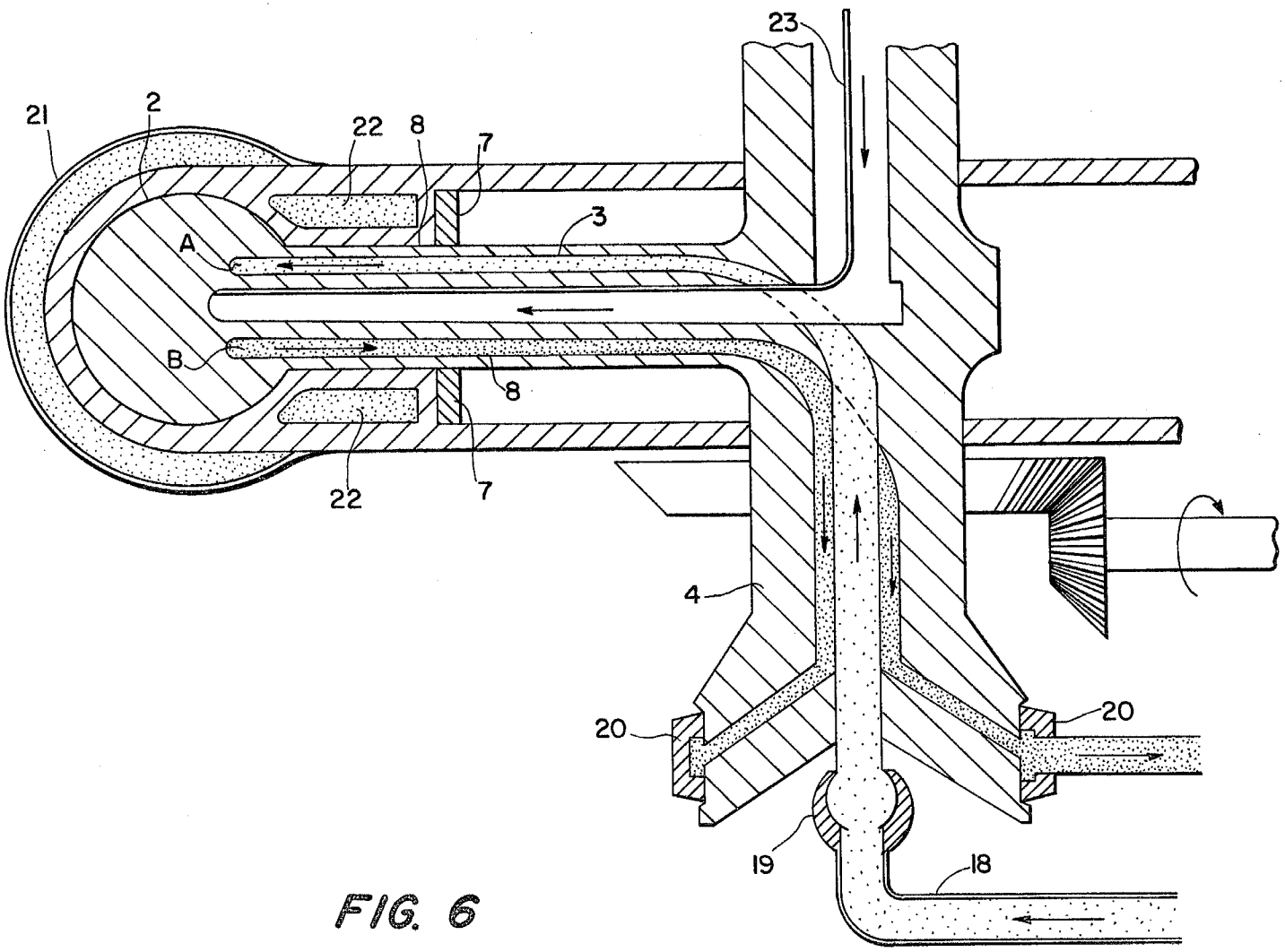
FIG. 6 is a fragmentary vertical section, showing a fluid cooling system.

FIG. 6 illustrates a suggested cooling system. The cooling fluid, water for example, is delivered to the piston through the hollow central shaft 4 and the hollow rod 3. After the cooling fluid has cooled the front face of piston 1, the cooling fluid flows back through rod 3 and then through central shaft 4. The conduit for supply of the fresh water 18 is illustrated as connected to a turning tube coaxially positioned within shaft 4 by means of rotary tight knee-joint 19. Upon return the warmed water is routed outside of the hollow shaft 4 by means of concentric bracelet type tight joint 20 which remains stationary as shaft 4 rotates. If necessary, the cooling water may be circulated by a pump. The same water may be re-used in a continuous circuit as in any conventional engine having a cooling radiator (not illustrated).

Furthermore, and in order to obtain a better working temperature the outside of the annular chamber 2 is surrounded as illustrated by casing 21 in which cooling water also circulates, as well as inside two spaces 22 defined between annular chamber 2 and the cylindrical drum 7 on both faces of open neck guide 8. The cooling water may be circulated with a pump and cooled with a radiator (not illustrated).

Figure 8:
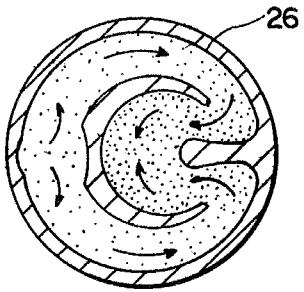
FIG. 8 is a transverse section, taken along section line 8—8, of FIG. 7, showing flowing of the coolant fluid within the anterior side of the pistonhead.

In case the exterior of the engine should be cooled with air, instead of water, casing 21 and spaces 22 could be replaced with gills or flanges (not illustrated). As illustrated in FIG. 8, casing 26 of the front face of the pistonhead could be modified with gills, such that forced air would be pumped through power shaft 4 and rod 3, instead of water.

Figure 7:
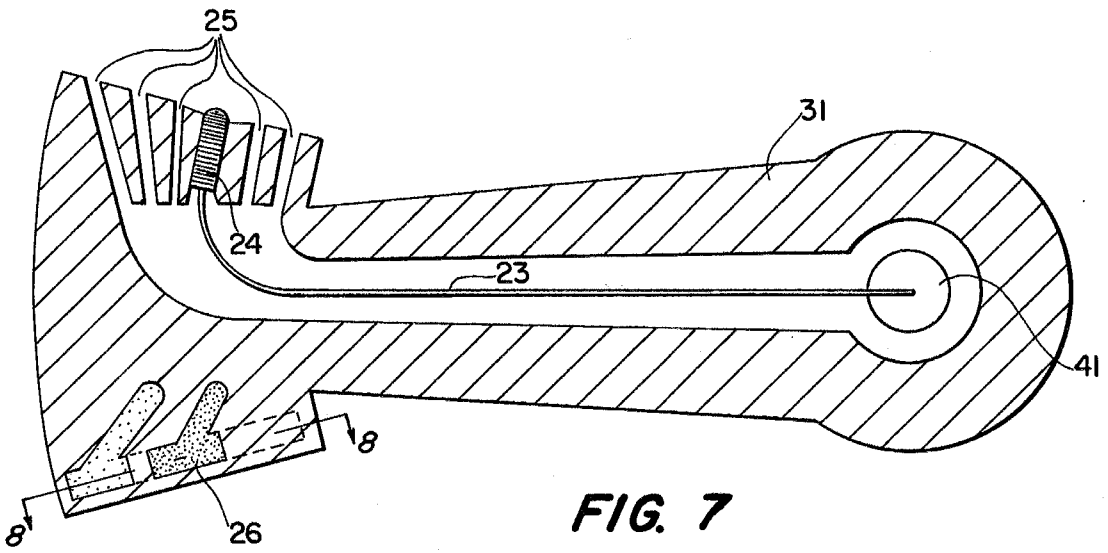
FIG. 7 is a transverse section of a system showing feeding of fuel and a combustive, such as air, to the posterior side of the pistonhead, while flowing cooling liquids through the anterior side of the pistonhead.

FIG. 7 illustrates water cooling and insulation of the front face of the piston, as well as the feeding of fuel and air through the back face of the same pistonhead. The air and the fuel are supplied separately; the fuel may be supplied through conduit 23 coaxially positioned inside the shaft and connected to the injection pump, thanks to a rotary tight joint, such as a knee joint. Conduit 23 may be connected to one or more injectors 24 supported on the back face of the piston to spray the fuel. Pressurized air is delivered separately through the hollow shaft 4 and hollow rod 3 to one or more openings 25 defined on the back face of the pistonhead. Therefore, the mixture of the air with the fuel is done inside annular chamber 2 where the combustion has to take place. No flash back can take place nor has to be feared, as neither element can burn separately from the other element.

Cooling of the front face of the piston with circulating water is proposed as illustrated in FIGS. 7 and 8, the cooled water arrives adjacent the exterior face of the especially shaped flat casing 26. After the cooled water circulates along both sides of casing 26, as the water flows it will arrive to the central or axial portion from whence the water flows back through rod 3 and shaft 4 up to the radiator for re-cooling and re-cycling in continuous travel.

Advantages of this type of rotary engine (1) All moving parts are driven by a rotary movement around shafts, rather than by alternating reciprocating eccentric, or other movements which are the source of vibrations and noises resulting in rapid wear and tear.

(2) Numerous parts present in conventional two-cycle and four-cycle engines, some of which are difficult to manufacture, become entirely unnecessary, as, for example, crankshafts, rod bearings, camshafts, friction rollers, trip levers, rocker arms, springs, valves and the like.

(3) Great simplicity and a construction cost definitely lower than that of comparable products.

(4) Longevity likely as a result of rotary movement with its absence of vibrations.

(5) Possibility of obtaining a high number of revolutions per minute without danger of breakage.

(6) Smooth functioning, in comparison with the functioning of a "standard" reciprocating engine, and possible elimination of transmission gear cases.

(7) Superior performance and reduced fuel consumption on account of the particular characteristics and the profitable operation of the single-cycle engine.

(8) The possibility of using low-priced motor fuels, such as gasoline with a low octane rating, a gas-oil mixture, kerosene, vaporous gas or the like.

(9) Less pollution because of the motor fuels used.

(10) The possibility of limiting oneself to a few cylinder types to satisfy a wide variety of needs, for example, from small vehicles to trucks or ships, due to the fact that it is practicable to connect or join several rotary engines similar to the one described and with a single central shaft 4, in order to obtain greater power.

(11) A not negligible gyroscopic effect which makes it possible to gain better stability in those cases where the wholly rotary engine is mounted on certain vehicles.

I claim:

1. A rotary engine of the internal combustion type having constant fuel feeding comprising:

(A) a housing defining an outer annular chamber having an outer wall and an inner wall and adapted for explosion and expulsion of fuel, said annular chamber further including:

i. an ignition mechanism;

ii. an expulsion port peripherally spaced from said ignition mechanism;

iii. an open neck guide extending radially inward from said chamber;

(B) a hollow drive shaft extending transversely through said housing;

(C) a rotating cylindrical drum supported upon said drive shaft within said housing and defining an inner core thereof, said cylindrical drum sealingly engaging the inner wall of said annular chamber and said open neck guide;

(D) a piston rod attached to said drive shaft and extending radially through said cylindrical drum and said open neck guide, such that its outer end defines a rotatable piston head engaging the outer and inner walls of said annular chamber during a rotation through its circular cycle and including a fuel and air passage extending centrally through said rod and through a posterior side of said piston head;

(E) a moving seal interposed between said ignition mechanism and said expulsion port, said moving seal being of the rotary type mounted upon a shaft supported in said housing and rotatingly engageable with said cyclindrical drum, said moving seal including a complementary recess engaging said piston head during a rotation of its circular cycle intermediate said expulsion port and said ignition point; and (F) a source of pressurization and an unobstructed means continuously feeding separately fuel and air through said hollow shaft and said piston rod and piston head and into said chamber.

2. A rotary engine of the type having constant fuel feeding as in claim 1, said moving seal including a complementary recess engaging said pistonhead during a portion of its circular cycle intermediate said expulsion port and said ignition point.

3. A rotary engine of the type having constant fuel feeding as in claim 2, said cylindrical drum sealingly engaging the inner wall of said annular chamber.

4. A rotary engine of the type having constant fuel feeding as in claim 3, said annular chamber including an open-neck guide intermediate said chamber and the periphery of said cylindrical drum.

5. A rotary engine of the type having constant fuel feeding as in claim 3, said cylindrical drum sealingly engaging said inner wall of said annular chamber as an air-tight and water-tight seal.

6. A rotary engine of the type having constant fuel feeding as in claim 5, said housing hermetically enclosing said cylindrical drum and said moving sealing means.

7. A rotary engine of the type having constant fuel feeding as in claim 6, said piston being curved complementally with the periphery of said inner and outer walls of said annular chamber.

8. A rotary engine of the type having constant fuel feeding as in claim 1, said cylindrical drum and said moving seal having co-equal exterior diameters and rotated at substantially equal speeds.

9. A rotary engine of the type having constant fuel feeding as in claim 8, said pistonhead posterior side defining fuel injection and air injection passage.

10. A rotary engine of the type having constant fuel feeding as in claim 9, said pistonhead defining within its anterior side a plurality of fluid circulating cooling passages.

* * * * *